US006552479B2

(12) United States Patent
Komiya et al.

(10) Patent No.: US 6,552,479 B2
(45) Date of Patent: Apr. 22, 2003

(54) CATHODE RAY TUBE HAVING AN IMPROVED HEATER

(75) Inventors: Toshifumi Komiya, Mobara (JP); Norio Iwamura, Chousei (JP); Sachio Koizumi, Mobara (JP)

(73) Assignee: Hitachi, Ltd., Tokyo (JP)

( * ) Notice: Subject to any disclaimer, the term of this patent is extended or adjusted under 35 U.S.C. 154(b) by 62 days.

(21) Appl. No.: 09/912,325

(22) Filed: Jul. 26, 2001

(65) Prior Publication Data

US 2002/0033660 A1 Mar. 21, 2002

(30) Foreign Application Priority Data

Sep. 19, 2000 (JP) ..... 2000-283506

(51) Int. Cl.[7] ..... H01J 1/20; H01J 19/14
(52) U.S. Cl. ..... 313/337; 313/409; 313/37
(58) Field of Search ..... 313/337, 446, 313/270, 340, 37

(56) References Cited

U.S. PATENT DOCUMENTS 3,952,224 A * 4/1976 Evans, Jr. ..... 313/414
4,149,104 A * 4/1979 Yoshimori ..... 313/340
4,185,223 A * 1/1980 Anezaki ..... 313/446
4,471,260 A * 9/1984 Hasker et al. ..... 313/346 R
5,729,082 A * 3/1998 Snijkers ..... 313/346 R
5,959,398 A * 9/1999 Snijkers et al. ..... 313/446
6,191,528 B1 * 2/2001 Iwamura et al. ..... 313/446
6,335,590 B2 * 1/2002 Iwamura et al. ..... 313/446

* cited by examiner

*Primary Examiner*—Sandra O'Shea
*Assistant Examiner*—Dalei Dong
(74) *Attorney, Agent, or Firm*—Antonelli, Terry, Stout & Kraus, LLP

(57) ABSTRACT

A cathode ray tube has an electron gun including an indirectly heated cathode structure having a heater therein. The heater has a major heating portion formed of a spirally wound heating wire and two leg portions connected to opposite ends of the major heating portion. The two leg portions are welded to electrical conductors for applying voltages thereto at portions in the vicinity of open ends of the two leg portions, respectively, and the heater is covered with an insulating film except for the portions for welding. The two leg portions includes at least five layers of winding formed by spirally winding heating wires identical with the heating wire of the major heating portion, and the numbers of turns per unit length in each of the at least five layers of winding are smaller than a number of turns per unit length of the heating wire of the major heating portion.

4 Claims, 10 Drawing Sheets

31
P1
CL
40
A
P
B
Q
C
R
D
S
P2
G
T
E
F
H
U
I
V
J
W
X
M
N
HT
HD
HQL
K
L

CATHODE RAY TUBE HAVING AN IMPROVED HEATER

BACKGROUND OF THE INVENTION

The present invention relates to a cathode ray tube having an electron gun employing an indirectly heated cathode, and in particular to a cathode ray tube having reduced a power consumption of a heater serving as a heating element of the indirectly heated cathode.

Cathode ray tubes such as TV picture tubes and display tubes are widely used as a display means in various kinds of information processing equipment because of their capability of high-resolution image reproduction.

The cathode ray tubes of this kind include an evacuated envelope comprising a panel portion having a phosphor screen formed of phosphors coated on its inner surface, a neck portion and a funnel portion for connecting the panel portion and the neck portion, an electron gun housed in the neck portion comprising an electron beam generating section including an indirectly heated cathode, a control electrode and an accelerating electrode, and a main lens section formed of plural electrodes for focusing and accelerating an electron beam generated in the electron beam generating section toward the phosphor screen, and a deflection yoke mounted around the funnel portion for scanning the phosphor screen with the electron beam emitted from the electron gun.

FIG. 6 is a schematic cross-sectional view of a shadow mask type color cathode ray tube for explaining an example of a structure of a cathode ray tube. Reference numeral 1 denotes a panel portion, 2 is a funnel portion, 3 is a neck portion, 4 is a phosphor screen formed of phosphors coated on the inner surface of the panel portion 1, 5 is a shadow mask serving as a color selection electrode, 6 is a magnetic shield for shielding an external magnetic field (the Earth's magnetic field) for preventing the Earth's magnetic field from changing the trajectory of electron beams. Reference numeral 7 denotes a deflection yoke, 8 is external magnets for beam adjustment, 9 is an electron gun provided with indirectly-heated cathodes for emitting three electron beams and 10 are the three electron beams only one of which is shown.

The three electron beams 10 from the electron gun 9 are modulated by video signals from an external signal processing circuit (not shown), respectively, and are projected toward the phosphor screen 4. The electron beams 10 scan the phosphor screen 4 two-dimensionally by being subjected to the horizontal and vertical deflection magnetic fields generated by the deflection yoke 7 mounted around the transition region between the neck portion 3 and the funnel portion 2. The shadow mask 5 reproduces a desired image by passing the three electron beams through a large number of apertures therein to the phosphor screen such that each beam impinges upon and excites only one of the three kinds of color phosphor elements in the phosphor screen.

FIG. 7 is a side elevation view of the electron gun 9 for explaining an example of a structure of the electron gun 9 used for the color cathode ray tube shown in FIG. 6. The electron gun 9 comprises a control electrode (the first grid electrode or G1) 11, an accelerating electrode (the second grid electrode or G2) 12, focus electrodes (the third grid electrode or G3, the fourth grid electrode or G4, and the fifth grid electrode or G5) 13, 14, 15, an anode (the sixth grid electrode or G6) 16, and a shield cup 17 physically retained in axial predetermined spaced relationship in the order named by multiform glasses 20, and the respective electrodes are electrically connected to respective stem pins 18*a* implanted in a stem 18 by welding to the stem pins 18*a* a tab or a lead provided to the electrodes.

In this electron gun 9, an indirectly heated cathode structure 21 is spaced closely from the electron beam apertures in the control electrode 11 toward the stem 18, and has heaters for heating the electron-emissive layers.

Reference numeral 19 denote bulb spacer contacts for centering the central longitudinal axis of the electron gun 9 coincident with the axis of the neck portion 3 by pressing resiliently against the inner wall of the neck portion 3 and for effecting delivery of an anode voltage from the internal conductive coating coated on the inner walls of the funnel portion 2 and the neck portion 3 to the electron gun 9.

The indirectly heated cathode structure 21, the control electrode 11 and the accelerating electrode 12 form an electron beam generating section (a triode portion). The focus electrodes 13 to 15 accelerate and focus the electron beams emitted from the electron beam generating section, and then a main lens formed between the focus electrode 15 and the anode 16 focuses the electron beams onto the phosphor screen.

The stem 18 is fused to close the open end of the neck portion 3 of the vacuum envelope, and signals and voltages from external circuits are applied to the respective electrodes via the stem pins 18*a*. The external magnets 8 (a magnet assembly) for beam adjustment shown in FIG. 6 correct errors in landing of the electron beams on the phosphor picture elements caused by a delicate misalignment in axis or a delicate rotational error between the electron gun 9 and the panel portion 1, the funnel portion 2 and the shadow mask 5.

FIG. 8 is a cross-sectional view of the indirectly heated cathode structure 21 shown in FIG. 7. The indirectly heated cathode structure 21 comprises bead supports 22, an eyelet 23, heater supports 24, a heater 25, a base metal 27 for supporting an electron-emissive material 26, a cathode support sleeve 28 and a cathode cylinder 29.

The indirectly heated cathode structure 21 is fixed on multiform glasses 20 by the eyelet 23 and the bead supports 22. The heater 25 housed within the cathode support sleeve 28 are fixed by welding its ends (leg portions) to the heater support 24.

FIGS. 9A and 9B are illustrations of a structure of the heater 25, FIG. 9A being a side view of the heater 25 and FIG. 8B being an enlarged fragmentary cross-sectional view of the encircled portion designated "A" in FIG. 9A. As shown in FIG. 9B, the heater 25 comprises a tungsten wire 31 spirally wound, an alumina insulating layer 32 coated around the tungsten wire 31, and a blackened fine-powder tungsten layer 33 coated around the alumina insulating layer 32. The blackened layer 33 is intended for lowering the temperature required of the heater 25 by improving the heat radiation from the heater 25, and consequently improving the reliability of the heater 25.

In FIG. 9A, reference character HT denote leg portions of the heater 25 comprised of tungsten wires spirally wound in three layers, HD is a major heating portion of the heater 25 formed by winding spirally in a large diameter a tungsten coiled wire having been wound initially spirally in a small diameter (hereinafter referred to merely as a coiled coil portion), HA is a portion coated with alumina, HB is a blackened portion covered with the blackened fine-powder tungsten layer 33, HE are portions not covered with alumina and reference numeral 39 in FIG. 9B denotes a hollow formed after dissolving and removing a molybdenum mandrel.

A method of forming the leg portions HT of the heater by winding tungsten wires in three layers is disclosed in Japanese Patent Application Laid-open No. Hei 11-354041 (laid-open on Dec. 24, 1999).

FIGS. 10A–10E illustrate sequence of steps in a conventional method of fabricating the conventional heater.

In FIG. 10A, a tungsten wire 31 is wound spirally forward as indicated by an arrow P around a molybdenum mandrel wire 40 up to point A.

Next, as illustrated in FIG. 10B, the tungsten wire 31 is wound spirally backward from point A to point B as indicated by an arrow Q.

Then, as illustrated in FIG. 10C, the tungsten wire 31 is wound spirally forward again from point B to point C over a centerline CL for folding in a subsequent process, as indicated by an arrow R, forming a three-layer winding portion TWA ranging from point A to point B.

Next, as illustrated in FIG. 10D, the tungsten wire 31 is wound spirally backward from point C to point D as indicated by an arrow S.

Next, as illustrated in FIG. 10E, the tungsten wire 31 is wound spirally forward again from point D to point E as indicated by an arrow T, forming a three-layer winding portion TWB ranging from point C to point D.

The tungsten wire thus wound around the molybdenum mandrel wire 40 is cut at the respective centers F, G of the three-layer winding portions TWA and TWB to provide a tungsten wire winding having a length HQL for one heater with the leg portions TWLA, TWLB of three-layer winding, and the tungsten wire winding of the length HQL is formed into a final shape by folding the length HQL in two halves at the centerline CL and twisting the two halves around each other as shown in FIG. 9A. Then, the molybdenum mandrel wire 40 is dissolved with acid, leaving the hollow 39 as shown in FIG. 9B.

The heater having the leg portions of the above three-layer winding structure provides the following advantages:

(i) prevention of breaks of a tungsten wire by sparks within a cathode ray tube, (ii) reduction of power consumption by concentration of heat generation in the coiled coil portion HD (see FIG. 9A) due to low resistance of the three-layer winding portions and resultant reduced heat generation, (iii) improvement in workability in the operation of welding the heater, (iv) suppression of heat generation in the portions not covered with alumina caused by an overcurrent upon power turn on.

Incidentally, in referring to the number of winding layers, an n-layer winding, or an n-layer structure can also be used in addition to "wound inn layers, in this specification.

SUMMARY OF THE INVENTION

The tungsten wire used for heaters are very thin, and are usually 30 $\mu$m to 50 $\mu$m in diameter. The structure of the wound thin wires is very weak in mechanical strength, and welding of heaters to a heater support requires a great deal of skill. The three-layer winding structure improves workability in welding heaters, and suppresses occurrences of breaks of heaters by sparks or overcurrents upon power turn on.

In the above-explained heater, consideration has been given to reduction of power consumption and workability in welding, but recently further reduction of power consumption is needed in view of energy saving.

There is a limit to reduction of the heater power consumption obtained by forming the heater leg portions by winding in plural layers only, because reduction of electrical resistance by layer shorts is not great.

It is an object of the present invention to provide a cathode ray tube provided with an indirectly heated cathode structure having reduced its power consumption by reducing electrical resistances of its heater leg portions without deteriorating workability in welding.

To achieve the above object, in accordance with an embodiment of the present invention, there is provided a cathode ray tube comprising: an evacuated envelope comprising a panel portion, a neck portion, a funnel portion for connecting the panel portion and the neck portion and a stem having a plurality of pins therethrough and being sealed to close the neck portion at one end thereof; a phosphor screen formed on an inner surface of the panel portion; an electron gun housed in the neck portion, the electron gun comprising an electron beam generating section including an indirectly heated cathode structure having a heater therein, a control electrode and an accelerating electrode, and a plurality of electrodes disposed downstream of the electron beam generating section for focusing and accelerating an electron beam emitted from the electron beam generating section toward the phosphor screen; and a deflection yoke mounted externally around the funnel portion for scanning the electron beam on the phosphor screen; the heater comprising a major heating portion having a spirally wound heating wire and two leg portions connected to opposite ends of the major heating portion, the two leg portions being welded to electrical conductors for applying voltages thereto at portions in the vicinity of open ends of the two leg portions, respectively, the heater being covered with an insulating film except for the portions for welding, the two leg portions comprising at least five layers of winding formed by spirally winding heating wires identical with the heating wire of the major heating portion, and numbers of turns per unit length in each of the at least five layers of winding in the two leg portions being smaller than a number of turns per unit length of the heating wire of the major heating portion.

To achieve the above object, in accordance with another embodiment of the present invention, there is provided a cathode ray tube comprising: an evacuated envelope comprising a panel portion, a neck portion, a funnel portion for connecting the panel portion and the neck portion and a stem having a plurality of pins therethrough and being sealed to close the neck portion at one end thereof; a phosphor screen formed on an inner surface of the panel portion; an electron gun housed in the neck portion, the electron gun comprising an electron beam generating section including an indirectly heated cathode structure having a heater therein, a control electrode and an accelerating electrode, and a plurality of electrodes disposed downstream of the electron beam generating section for focusing and accelerating an electron beam emitted from the electron beam generating section toward the phosphor screen; and a deflection yoke mounted externally around the funnel portion for scanning the electron beam on the phosphor screen; the heater comprising a major heating portion having a spirally wound heating wire and two leg portions connected to opposite ends of the major heating portion, the two leg portions being welded to electrical conductors for applying voltages thereto at portions in the vicinity of open ends of the two leg portions, respectively, the heater being covered with an insulating film except for the portions for welding, the two leg portions comprising at least three layers of winding formed by spirally winding heating wires identical with the heating wire of the major heating portion, numbers of turns per unit length in each of the at least three layers of winding in the two leg portions being smaller than a number of turns per unit length of the heating wire of the major heating portion, and the numbers of turns per unit length in each of the at least three layers of winding in the two leg portions being within a plus or minus variation of not greater than 30% in the at least three layers.

The present invention is not limited to the above structures, and various changes and modifications may be made without departing from the scope of the invention as defined in the appended claims.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiments of the present invention will be explained in detail hereunder with reference to the accompanying drawings.

Figure 1:
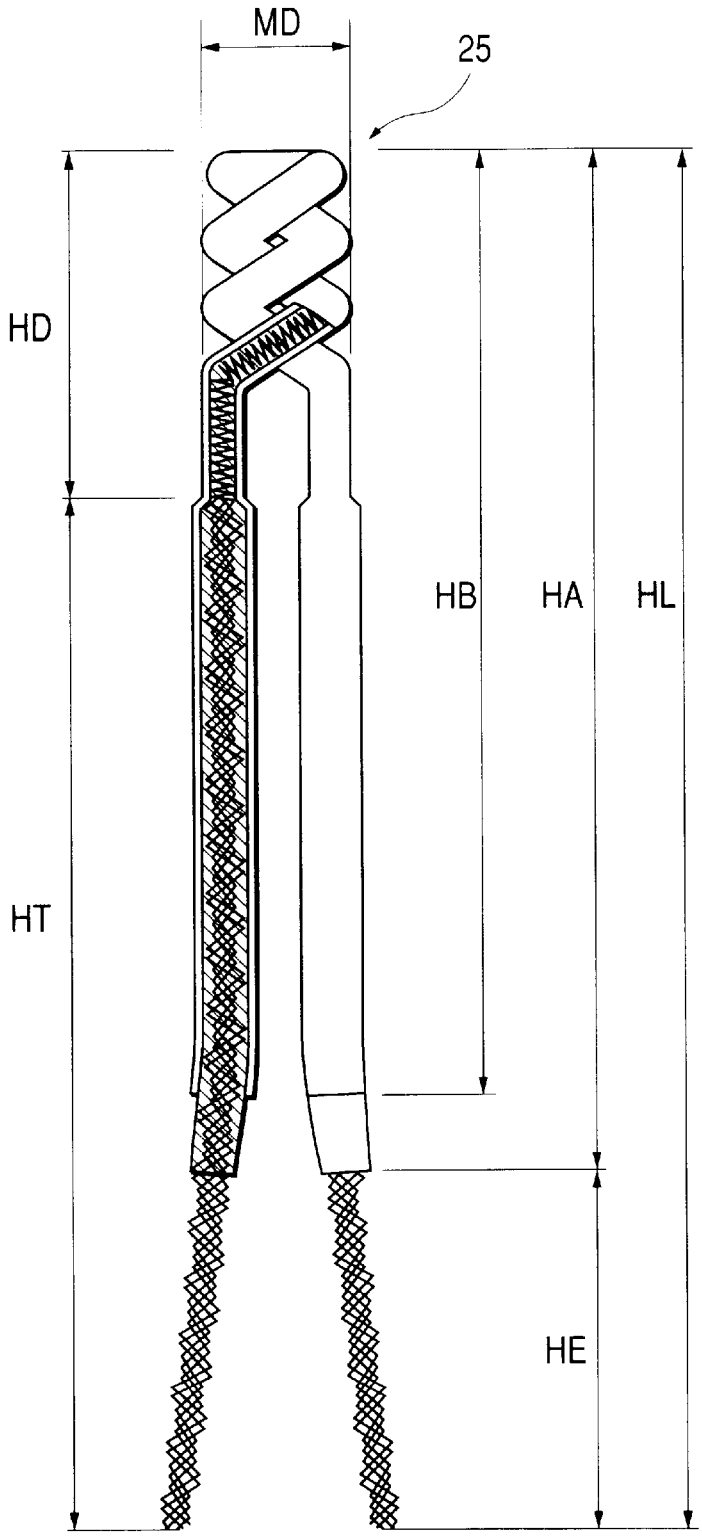
FIG. 1 is a partially broken-away side view of a heater used in an indirectly heated cathode structure in an embodiment of a cathode ray tube in accordance with the present invention.
Figure 8:
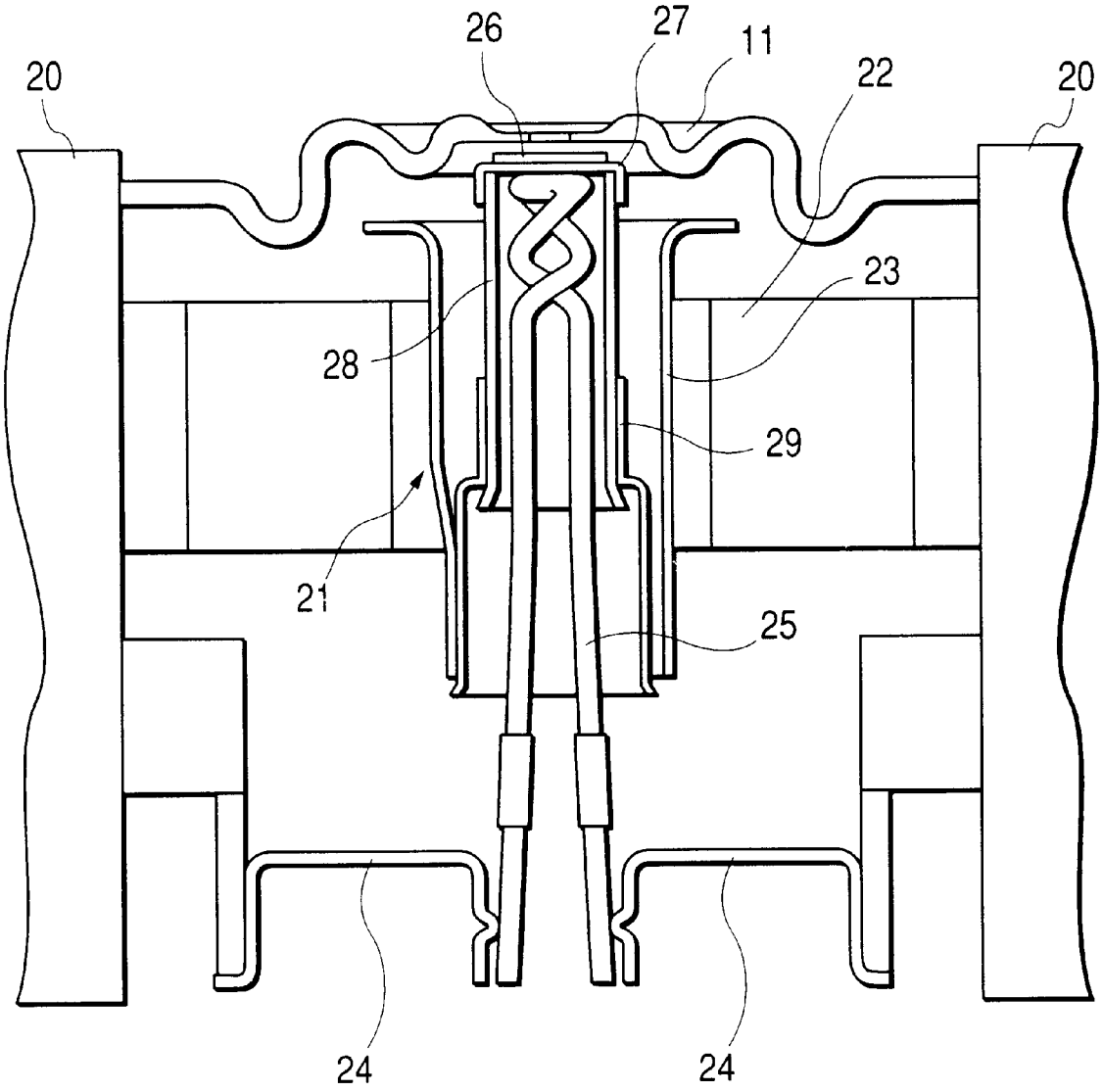
FIG. 8 is a cross-sectional view illustrating an example of an indirectly heated cathode structure used in the color cathode ray tube shown in FIG. 6.
Figure 9A:
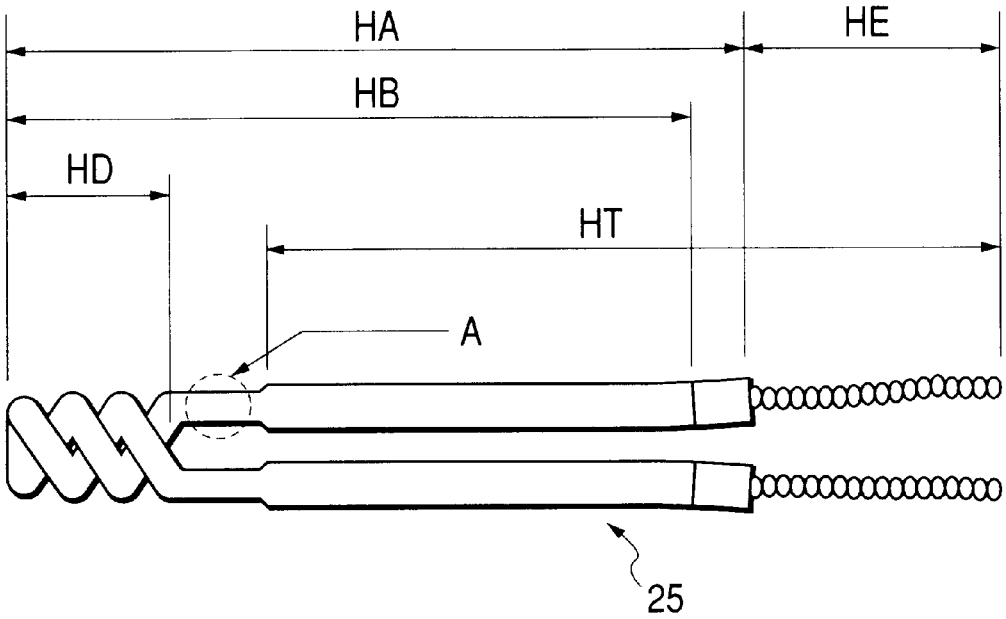
FIG. 9A is a side view of a typical heater.
Figure 9B:
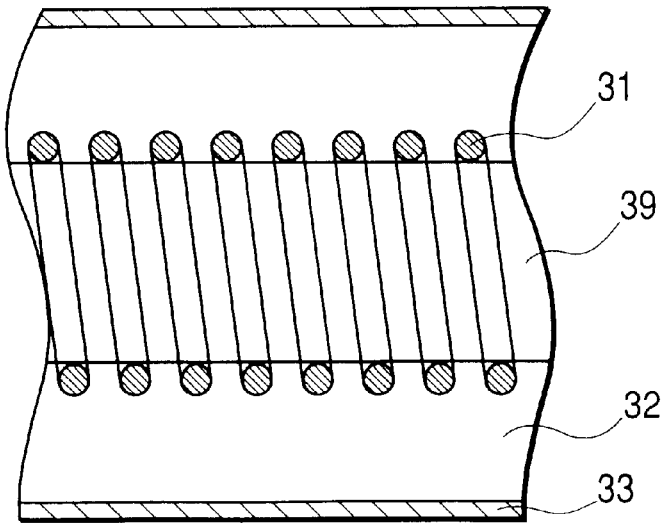
FIG. 9B is an enlarged fragmentary view of the encircled portion designated "A" in FIG. 9A.
Figures 10A, 10B, 10C, 10D, 10E:
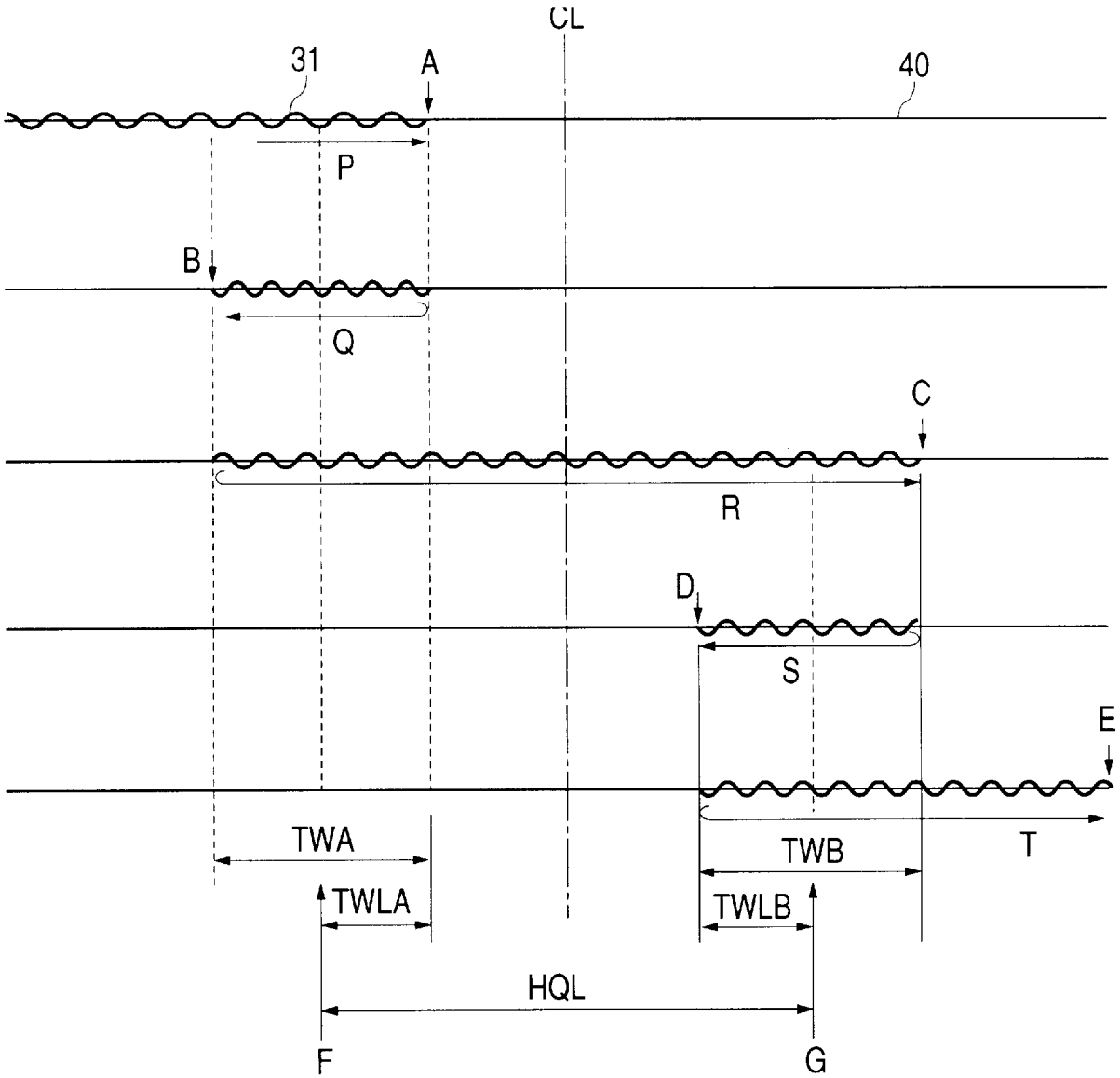
FIG. 10A PRIOR ART
FIG. 10B PRIOR ART
FIG. 10C PRIOR ART
FIG. 10D PRIOR ART
FIG. 10E PRIOR ART
FIGS. 10A to 10E illustrate sequence of steps in a method of fabricating a conventional heater.

FIG. 1 is a partially broken-away side view of a heater for use with an indirectly heated cathode structure for explaining an embodiment of a cathode ray tube of the present invention. The basic structure of the heater 25 is similar to the conventional heater explained in connection with FIG. 8. The tungsten wires are wound spirally, are coated with alumina, and then fine-powder tungsten is coated on the surface of the alumina insulating film, and then is blackened.

In FIG. 1, reference character HT denote heater leg portions formed by winding tungsten wires spirally in five layers, HD is a heat generating section (also called a major heating portion) formed by twisting a tungsten wire which has been spirally wound in a single layer at a winding pitch smaller than that of the heater leg portions HT, HB is a portion blackened with fine powders of tungsten and alumina, HA is a portion covered with alumina, and HE are leg portions which are open ends to welded to the heater supports and are not covered with alumina. The alumina-coated portion HA and the blackened portion HB are collectively called an insulating-film coated portion.

In a concrete example, the heat generating section HD is located in a region from a front end (the top in FIG. 1) to 3 mm the front end, and is formed by twisting a tungsten wire which has been spirally wound at a winding pitch of 15 turns/mm in a single layer. The leg portions HT are comprised of five layers each formed by spirally winding tungsten wires at a pitch of three turns/mm. The winding pitch of each of the five winding layers of the leg portions HT is greater than that of the heat generating section HD, and the number of the winding layers in the leg portions is five.

Dimensional examples for the structure in FIG. 1 are:

the diameter of the heating portion MD=1.4 mm, the length of the portion covered with alumina HA=9.0 mm, the length of the leg portion HT=9.0 mm, the overall length of the heater 25=12 mm, and the diameter of the heating tungsten wire=0.03 mm.

FIGS. 2A–2I illustrate sequence of steps in a method of fabricating continuously the heater 25 shown in FIG. 1.

Figures 2A, 2B, 2C, 2D, 2E, 2F, 2G, 2H, 2I:
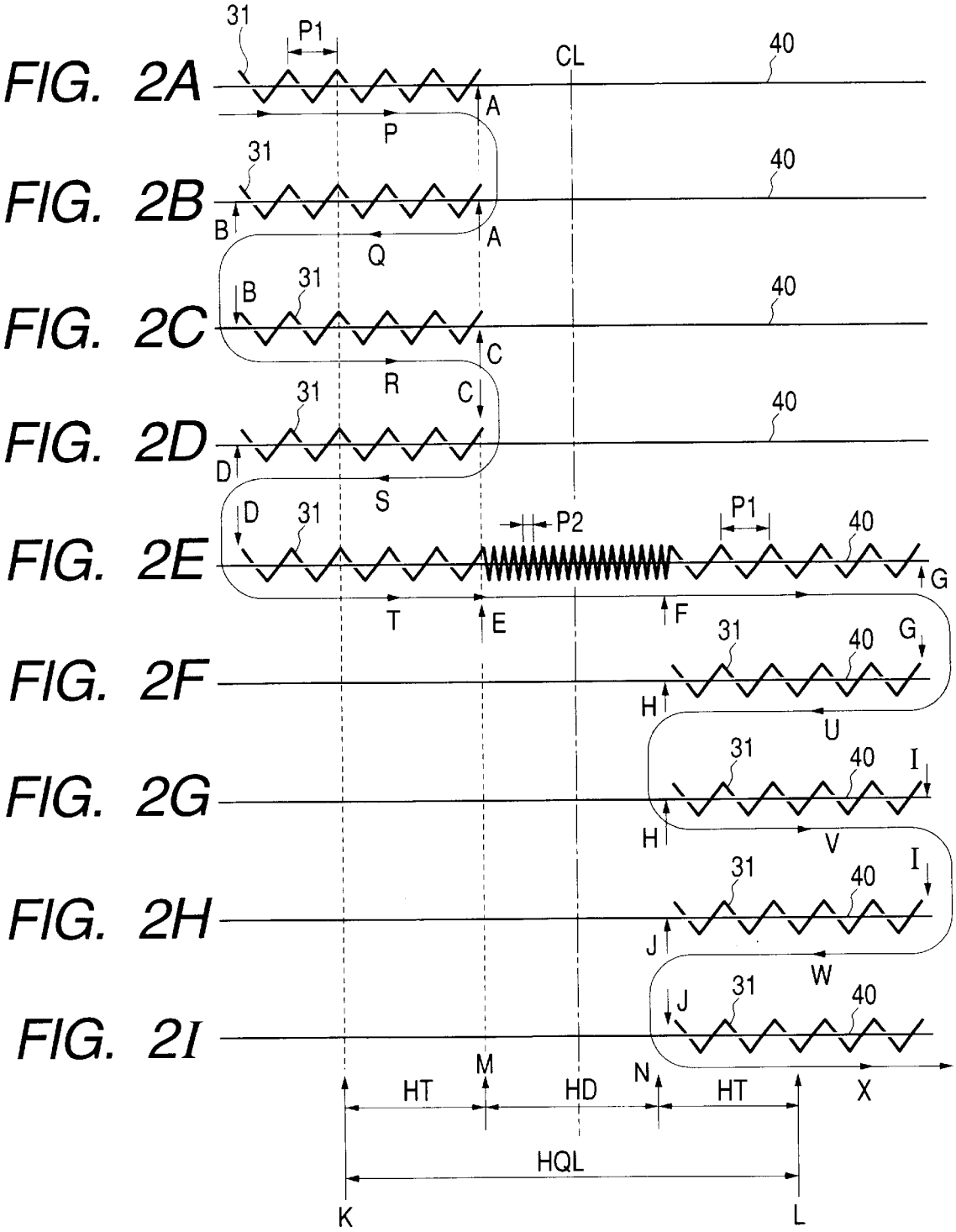
FIGS. 2A to 2I illustrate sequence of steps in a method of fabricating the heater shown in FIG. 1.

Initially, in FIG. 2A, a tungsten wire 31 of 0.030 mm in diameter is wound spirally forward at a winding pitch P1 (three turns/mm) as indicated by an arrow P around a molybdenum mandrel wire 40 of 0.150 mm in diameter up to point A from a starting point.

Next, as illustrated in FIG. 2B, the tungsten wire 31 is wound spirally backward at the winding pitch of P1 from point A to point B as indicated by an arrow Q.

Then, as illustrated in FIG. 2C, the tungsten wire 31 is wound spirally forward again at the winding pitch of P1 from point B to point C as indicated by an arrow R.

Next, as illustrated in FIG. 2D, the tungsten wire 31 is wound spirally backward at the winding pitch of P1 from point C to point D as indicated by an arrow S.

Then, as illustrated in FIG. 2E, the tungsten wire 31 is wound spirally forward again at the winding pitch of P1 from point D to point E as indicated by an arrow T. The winding operation up to this point completes a portion intended for one of the two leg portions HT as a five-winding-layer structure in which a winding pitch of each winding layer is P1. Next the tungsten wire 31 is wound spirally forward again at the winding pitch of P2 from point E to point F over a centerline CL for folding in a subsequent process as indicated by the arrow T, and as a result, the heat generating section HD is provided in which the tungsten wire 31 is spirally wound at the winding pitch of P2 in a single layer. The winding pitch P2 is selected to be 15 turns/mm, which is five times the number of turns/mm corresponding to the winding pitch of P1. Further, the tungsten wire 31 is wound spirally forward again at the winding pitch of P1 from point F to point G as indicated by an arrow T.

Next, as illustrated in FIG. 2F, the tungsten wire 31 is wound spirally backward at the winding pitch of P1 from point G to point H as indicated by an arrow U.

Next, as illustrated in FIG. 2G, the tungsten wire 31 is wound spirally forward at the winding pitch of P1 from point H to point I as indicated by an arrow V.

Next, as illustrated in FIG. 2H, the tungsten wire 31 is wound spirally backward at the winding pitch of P1 from point I to point J as indicated by an arrow W.

Next, as illustrated in FIG. 2I, the tungsten wire 31 is wound spirally forward again at the winding pitch of P1 from point J to an end point as indicated by an arrow X. The winding operation up to this point completes a portion from point F to the end point which is intended for the other of the two leg portions HT as a five-winding-layer structure in which a winding pitch of each winding layer is P1.

The tungsten wire thus wound around the molybdenum mandrel wire 40 is cut at the respective centers K, L of the five-layer winding portions to provide a tungsten wire winding having a length HQL for one heater having the two leg portions HT of the five winding layer structure (two portions between points K and M and between points Land N) of three-layer winding and the heat generating section HD (a portion between points M and N) disposed between the two leg portions HT. The tungsten wire winding of the length HQL is formed into a final shape by folding the length HQL in two halves at the centerline CL and twisting the two halves of the portion between points M and N around each other as shown in FIG. 1. Then, the molybdenum mandrel wire 40 is dissolved with acid.

As explained above, the heater is configured such that its heat generating section HD is formed by winding the tungsten wire at the winding pitch of P2 in a single layer and the twisting the wound tungsten wire, and such that the leg portions HT are formed by winding the tungsten wires in five layers at the winding pitch P1 greater than the winding pitch P2 of the heat generating section HD, and consequently, the electrical resistances of the leg portions HT are reduced, therefore heat generated by the leg portions HT is reduced, and power consumption is concentrated in the heat generating section HD of the single-winding-layer configuration. As a result, reduction of the heater power consumption is realized. Further, the leg portions HT formed of five winding layers with a greater pitch of P1 improves workability in welding the heater 25 to the heater supports 24 (see FIG. 8).

Now the reason will be explained that the heater structure of this embodiment provides the above advantages.

Figure 3:
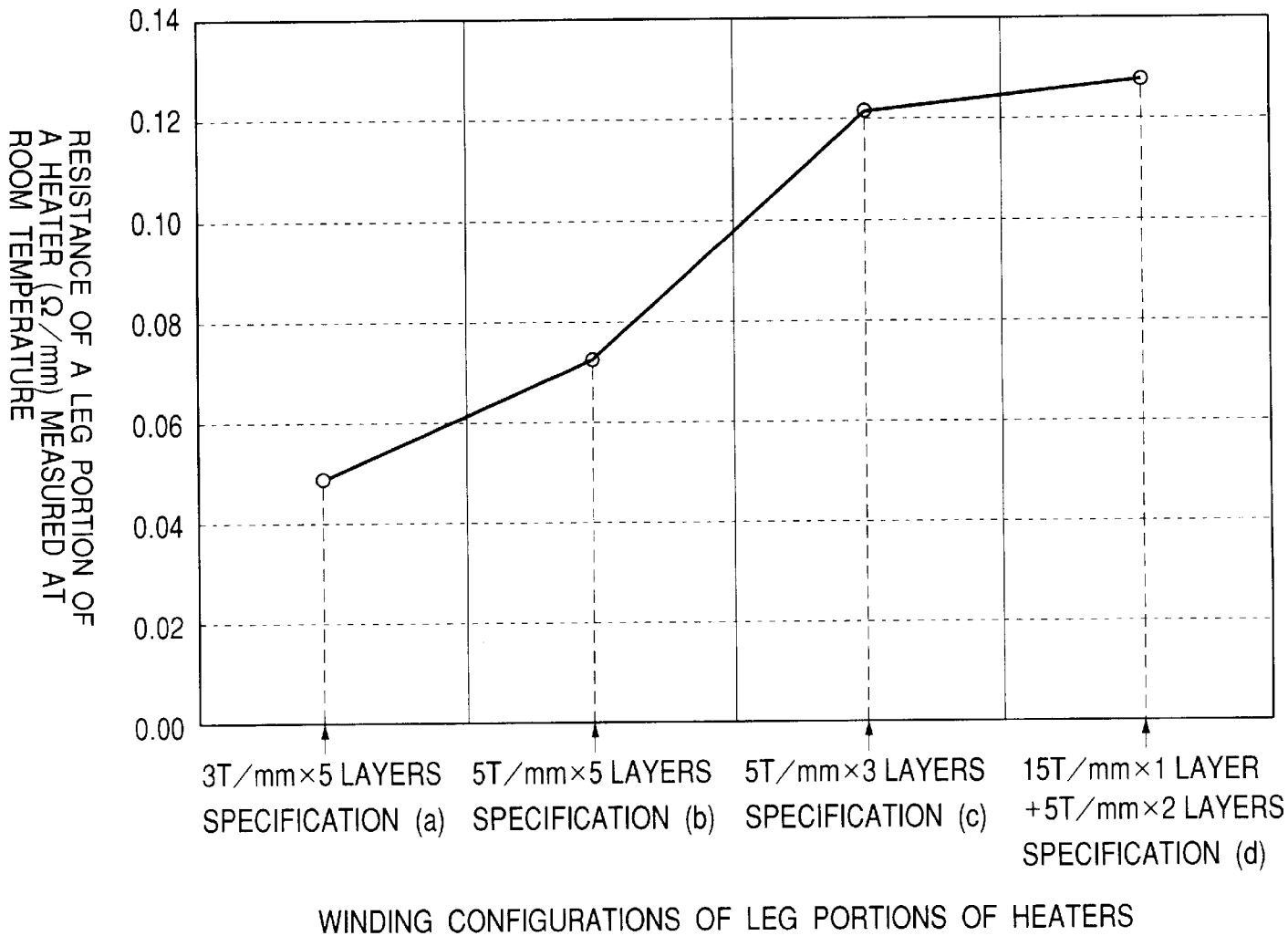
FIG. 3 is a graph showing a relationship between electric resistances and winding configurations of leg portions of heaters in terms of multiple-layer structures and winding pitches.

FIG. 3 is a graph showing a relationship between electric resistances and various winding configurations of leg portions of heaters in terms of multiple-layer structures and winding pitches, with the abscissa representing the winding specifications (a) to (d) of the heater leg portions in terms of winding pitches (turns/mm) and winding layers, and with the ordinate representing resistances (Ω/mm) of the heater leg portions at room temperature.

As is apparent from FIG. 3, the resistance of the leg portions can be reduced by increasing the number of the winding layers.

Figure 4:
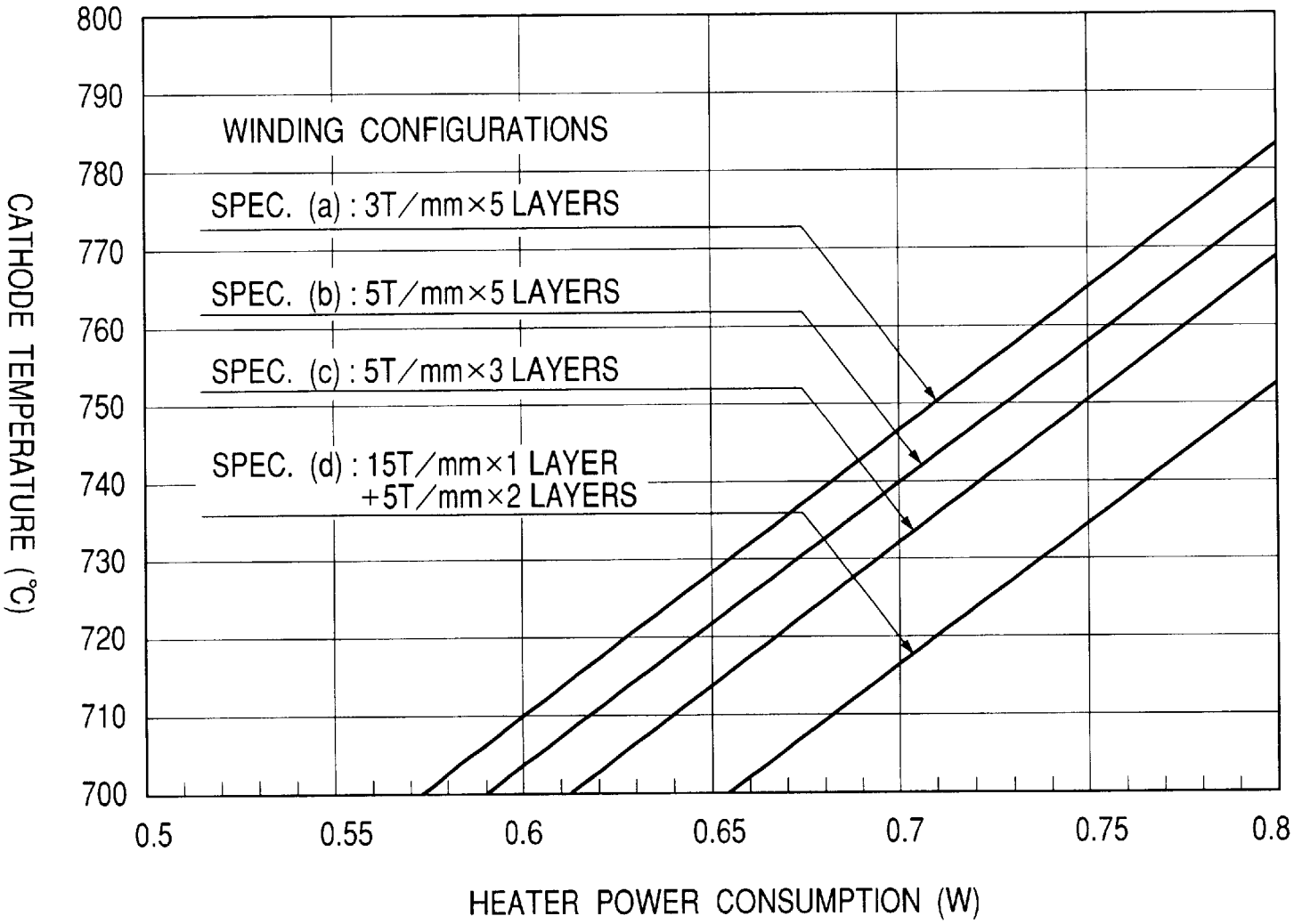
FIG. 4 is a graph showing a relationship between cathode temperatures and heater power consumption for various winding configurations of leg portions of heaters.

FIG. 4 is a graph showing a relationship between cathode temperatures and heater power consumption for various winding specifications of leg portions of heaters, with the abscissa representing heater power consumption (W), and with the ordinate representing cathode temperatures (° C.), and the specifications (a) to (d) correspond to those in FIG. 3, respectively.

As is apparent from FIG. 4, the cathode temperature for the fixed power consumption becomes higher in the order of the specifications (d)→(C)→(b)→(a), that is, as the resistances of the heater leg portions are reduced.

The results shown in FIGS. 3 and 4 have verified that reduction of the resistance of the heater leg portions and resultant reduction of the heater power consumption are realized when the winding specification of the heater leg portions is selected such that the number of turns per unit length is small (i.e., a larger winding pitch) and the number of winding layers is increased.

In this embodiment, the heat generating section is formed by winding a wire in a single layer, and the heater leg portions are formed by winding wires in five layers, but the similar advantages are obtained even when the heat generating section is formed of more than two winding layers and the leg portions are formed of three or more times the number of the winding layers of the heat generating section.

Figure 5:
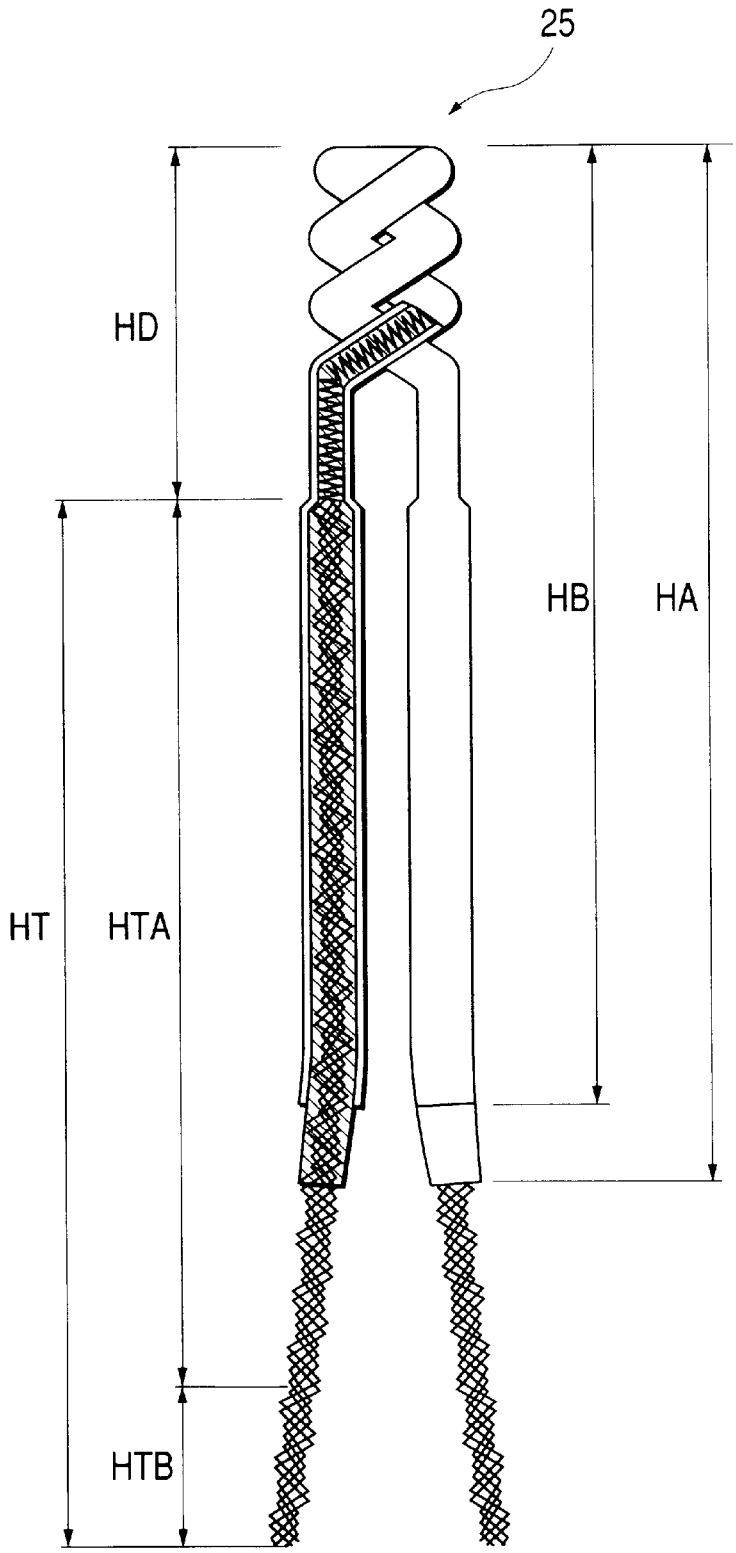
FIG. 5 is a partially broken-away side view of a heater used in an indirectly heated cathode structure in another embodiment of a cathode ray tube in accordance with the present invention.
Figure 6:
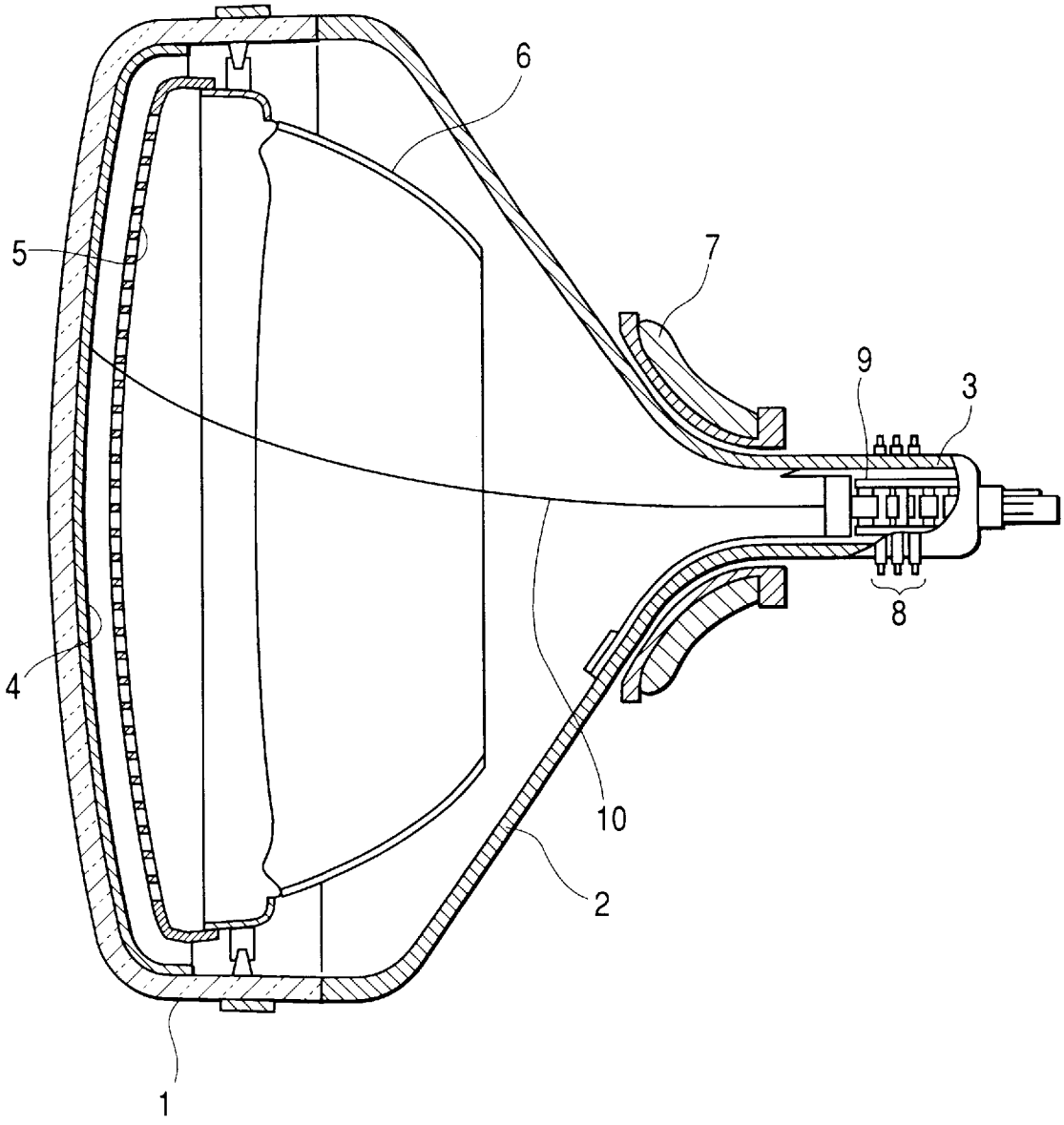
FIG. 6 is a schematic cross-sectional view of a shadow mask type color cathode ray tube as an example of a cathode ray tube.
Figure 7:
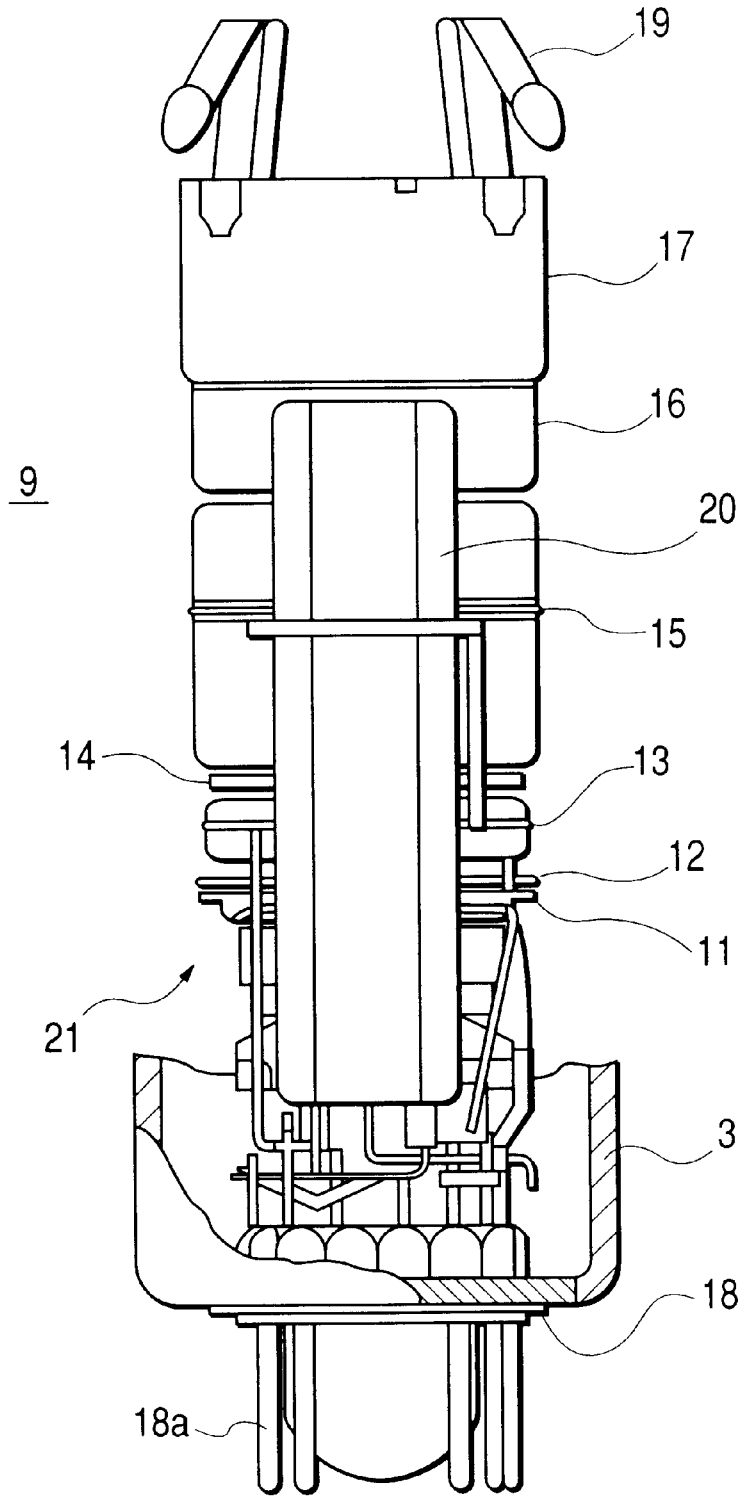
FIG. 7 is a cross-sectional sectional view illustrating an example of an electron gun used in the color cathode ray tube shown in FIG. 6.

FIG. 5 is a partially broken-away side view of a heater used in an indirectly heated cathode structure in another embodiment of a cathode ray tube in accordance with the present invention. The basic structure of this heater 25 is similar to that of the conventional heater explained in connection with FIG. 8, a tungsten wire is spirally wound, then is coated with an alumina insulating film, and then is blackened by coating the surface of the alumina insulating film with fine tungsten powders. The same reference numerals as utilized in FIG. 1 designate functionally similar portions in FIG. 5.

In this embodiment, portions HTB in the vicinity of the open ends of the heater leg portions HT to be welded to the heater supports 24 (see FIG. 8) are formed by initially winding a tungsten wire in a single layer at the same winding pitch of 15 turns/mm as that of the heat generating section HD and then winding the tungsten wires around the initially wound layer in four layers each wound at a winding pitch of 3 turns/mm. Intermediate portions HTA farther inward from the portions HTB are formed by winding the tungsten wire in five layers each wound at the same pitch of 3 turns/mm as in the embodiment explained in connection with FIG. 1. In this embodiment, the portions HTB to be welded to the heater supports 24 are formed with the smaller winding pitch, therefore the rigidity of the portions HTB is increased, and consequently, workability in welding of the portions HTB is improved. The intermediate portions HTA are formed to extend beyond the insulating-film coated portions HA, HB, therefore they reduce influences of physical strain caused by welding of the end portions HTB to the heater supports 24, on the insulating alumina film and suppress occurrence of damage such as cracks in the insulating alumina film, and consequently, the present embodiment provides the advantage of preventing the occurrence of loose particles within the cathode ray tube.

The configuration of the intermediate portions HTA is not limited to the configuration in which the tungsten wire is wound in five layers each of which is wound at the same winding pitch of 3 turns/mm as in the embodiment explained in connection with FIG. 1, but it is not needless to say that the similar advantages are obtained if a combination of another winding pitch and another number of winding layers is selected such that the rigidity of the portions HTB to be welded is greater than that of the intermediate portions HTA.

In addition to the above-described winding configurations, a further number of winding layers can be added to the above-explained five-winding-layer portions to obtain the heaters having the larger number of winding layers such as seven or nine winding layers.

In the above explanation, a structure of the heater leg portions of the five-winding-layer structure is taken as a preferable embodiment in accordance with the present invention. The leg portions of the three-winding-layer structure similar to the specification (c) shown in FIGS. 3 and 4 provides an advantage of the compact heater and simplification of its manufacturing steps. In the case of the leg portions of the three-winding-layer structure, it was experimentally confirmed that the advantages substantially equal to those obtained by the five-winding-layer structure if the numbers of turns per unit length in the leg portions are held within a plus or minus variation of not greater than 30% in the three layers. The heater having the leg portions of the three-winding-layer structure are fabricated by the process step illustrated in FIG. 2C through the process step illustrated in FIG. 2G.

In addition to the above-described winding configurations, a further number of winding layers can be added to the above-explained three-winding-layer portions to obtain the heaters having the larger number of winding layers such as five, seven or nine winding layers.

As explained above, in the representative configurations of the heater in accordance with the present invention, by making the winding pitch of the heater leg portions greater than that of the heat generating section, of the heater of the cathode structure of an electron gun used for a cathode ray tube, the resistances of the portions except for the heat generating section are reduced with resultant decrease in the heat generation in the portions except for the heat generating section, and consequently, the entire power consumption is reduced. Further, the present invention makes possible welding by an automatic machine, prevents occurrence of cracks in the alumina insulating film, and consequently, provides a cathode ray tube superior in reliability.

What is claimed is:

1. A cathode ray tube comprising:

an evacuated envelope comprising a panel portion, a neck portion, a funnel portion for connecting said panel portion and said neck portion and a stem having a plurality of pins therethrough and being sealed to close said neck portion at one end thereof;

a phosphor screen formed on an inner surface of said panel portion;

an electron gun housed in said neck portion, said electron gun comprising an electron beam generating section including an indirectly heated cathode structure having a heater therein, a control electrode and an accelerating electrode, and a plurality of electrodes disposed downstream of said electron beam generating section for focusing and accelerating an electron beam emitted from said electron beam generating section toward said phosphor screen; and a deflection yoke mounted externally around said funnel portion for scanning said electron beam on said phosphor screen;

said heater comprising a major heating portion having a spirally wound heating wire and two leg portions connected to opposite ends of said major heating portion, said two leg portions being welded to electrical conductors for applying voltages thereto at portions in the vicinity of open ends of said two leg portions, respectively, said heater being covered with an insulating film except for said portions for welding, said two leg portions comprising at least five layers of winding formed by spirally winding heating wires identical with said heating wire of said major heating portion, and numbers of turns per unit length in each of said at least five layers of winding in said two leg portions being smaller than a number of turns per unit length of said heating wire of said major heating portion.

2. A cathode ray tube comprising:

an evacuated envelope comprising a panel portion, a neck portion, a funnel portion for connecting said panel portion and said neck portion and a stem having a plurality of pins therethrough and being sealed to close said neck portion at one end thereof;

a phosphor screen formed on an inner surface of said panel portion;

an electron gun housed in said neck portion, said electron gun comprising an electron beam generating section including an indirectly heated cathode structure having a heater therein, a control electrode and an accelerating electrode, and a plurality of electrodes disposed downstream of said electron beam generating section for focusing and accelerating an electron beam emitted from said electron beam generating section toward said phosphor screen; and a deflection yoke mounted externally around said funnel portion for scanning said electron beam on said phosphor screen;

said heater comprising a major heating portion having a spirally wound heating wire and two leg portions connected to opposite ends of said major heating portion, said two leg portions being welded to electrical conductors for applying voltages thereto at portions in the vicinity of open ends of said two leg portions, respectively, said heater being covered with an insulating film except for said portions for welding, said two leg portions comprising at least three layers of winding formed by spirally winding heating wires identical with said heating wire of said major heating portion, numbers of turns per unit length in each of said at least three layers of winding in said two leg portions being smaller than a number of turns per unit length of said heating wire of said major heating portion, and said numbers of turns per unit length in each of said at least three layers of winding in said two leg portions being within a plus or minus variation of not greater than 30% in said at least three layers.

3. A cathode ray tube according to claim 1, wherein said number of turns per unit length of said heating wire of said major heating portion is approximately 15 turns/mm, and said numbers of turns per unit length in each of said at least five layers of winding in said two leg portions is approximately 3 turns/mm.

4. A cathode ray tube according to claim 2, wherein said number of turns per unit length of said heating wire of said major heating portion is approximately 15 turns/mm, and said numbers of turns per unit length in each of said at least three layers of winding in said two leg portions is approximately 5 turns/mm.

* * * * *